US011260683B2

(12) United States Patent
Bigford et al.

(10) Patent No.: US 11,260,683 B2
(45) Date of Patent: Mar. 1, 2022

(54) VENTS FOR FLUID DISPENSING ASSEMBLIES

(71) Applicant: HEWLETT-PACKARD DEVELOPMENT COMPANY, L.P., Spring, TX (US)

(72) Inventors: Rosanna L. Bigford, Corvallis, OR (US); Jeffrey F. Bell, Corvallis, OR (US); Alan R. Arthur, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,073

(22) PCT Filed: Oct. 16, 2017

(86) PCT No.: PCT/US2017/056733
§ 371 (c)(1),
(2) Date: Sep. 11, 2019

(87) PCT Pub. No.: WO2019/078809
PCT Pub. Date: Apr. 25, 2019

(65) Prior Publication Data

US 2021/0138811 A1 May 13, 2021

(51) Int. Cl.
*B41J 29/377* (2006.01)
*B41J 2/14* (2006.01)

(52) U.S. Cl.
CPC ..... *B41J 29/377* (2013.01); *B41J 2/1433* (2013.01)

(58) Field of Classification Search
CPC ..... B41J 29/377; B41J 2/1433
See application file for complete search history.

(56) References Cited

U.S. PATENT DOCUMENTS

| | | | | |
|---|---|---|---|---|
| 6,402,403 | B1 | 6/2002 | Speakman | |
| 9,216,545 | B2 | 12/2015 | Lee et al. | |
| 2002/0057320 | A1* | 5/2002 | Kaga | B41J 2/355 347/92 |
| 2004/0113996 | A1* | 6/2004 | Boyd | B41J 2/14072 347/85 |
| 2006/0192820 | A1 | 8/2006 | Umeda | |
| 2014/0132656 | A1 | 5/2014 | Gonzales et al. | |
| 2016/0144564 | A1 | 5/2016 | Padgett et al. | |

(Continued)

FOREIGN PATENT DOCUMENTS

| | | |
|---|---|---|
| CN | 1840336 | 10/2006 |
| CN | 102971151 | 3/2013 |
| CN | 205058835 | 3/2016 |

OTHER PUBLICATIONS

3D Printer—Quality Printing with Cooling Fans, https://www.youtube.com/watch?v=7LVu3lr10UQ.

(Continued)

*Primary Examiner* — Jason S Uhlenhake
(74) *Attorney, Agent, or Firm* — Trop Pruner & Hu PC

(57) ABSTRACT

In some examples, a fluid dispensing assembly removably mountable in a fluid dispensing system includes a body and a fluidic die attached to the body. A vent is arranged on the body to direct cooling airflow generated by an external airflow generator that is external of and separate from the fluid dispensing assembly into an inner portion of the fluid dispensing assembly, the inner portion being within the body.

14 Claims, 5 Drawing Sheets

(56) References Cited

U.S. PATENT DOCUMENTS

| | | | | |
|---|---|---|---|---|
| 2016/0271955 | A1* | 9/2016 | Ono | B41J 2/16585 |
| 2016/0288554 | A1* | 10/2016 | Nakamura | B41J 2/175 |
| 2016/0297110 | A1 | 10/2016 | Wu | |
| 2017/0008234 | A1 | 1/2017 | Cullen et al. | |
| 2018/0333971 | A1* | 11/2018 | Sasaki | B41J 11/002 |

OTHER PUBLICATIONS

3D Printer Tips and Tricks for Better Quality Results: Part 1, https://www.tweaktown.com/articles/6009/3d-printer-tips-and-tricks-for-better-quality-results-part-1/index.html.

* cited by examiner

VENTS FOR FLUID DISPENSING ASSEMBLIES

BACKGROUND

A printing system can include a printhead that has nozzles to dispense printing fluid to a target. In a two-dimensional (2D) printing system, the target is a print medium, such as a paper or another type of substrate onto which print images can be formed. Examples of 2D printing systems include inkjet printing systems that are able to dispense droplets of inks. In a three-dimensional (3D) printing system, the target can be a layer or multiple layers of build material deposited to form a 3D object.

BRIEF DESCRIPTION OF THE DRAWINGS

Some implementations of the present disclosure are described with respect to the following figures.

Figure 1:
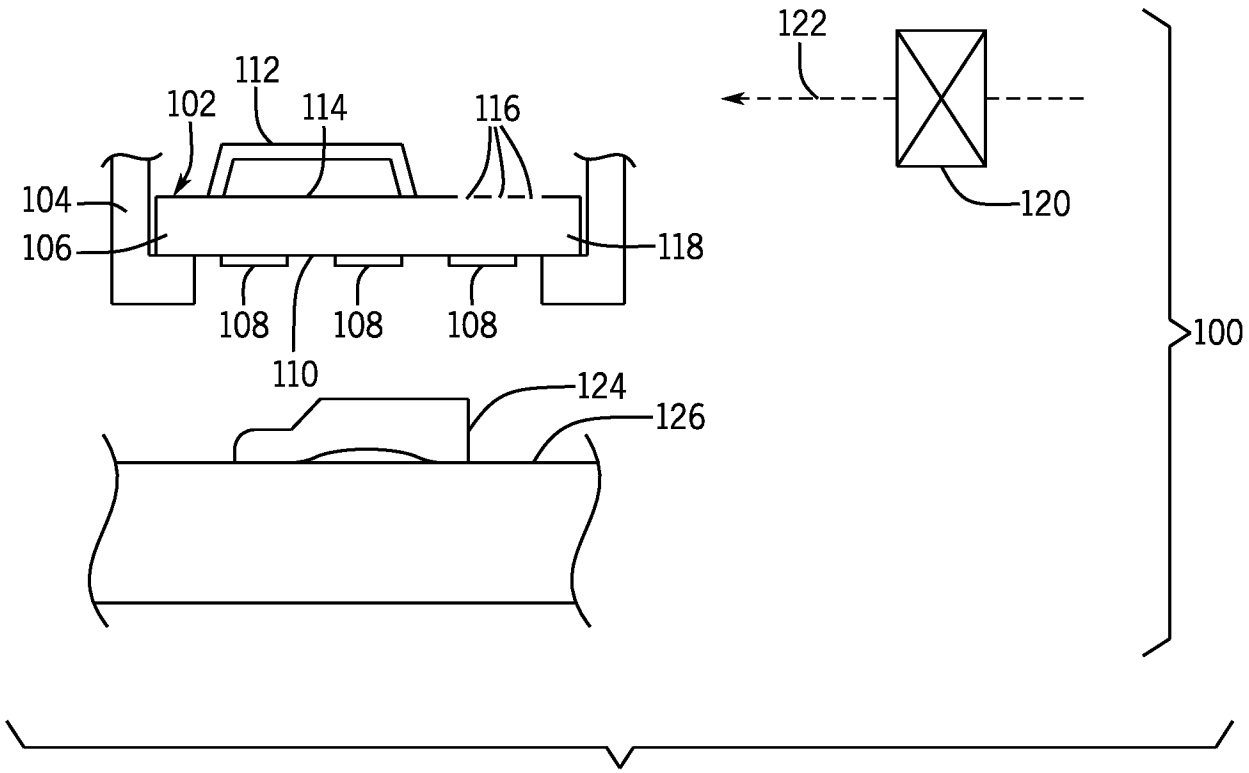
FIG. 1 is a block diagram of a fluid dispensing system according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

Also, terms such as "lower," "upper," "below," "above," or any other terms indicating relative orientations of components can refer to a relative orientation when the components are arranged vertically. However, if the components have a different arrangement (e.g., a horizontal arrangement, a diagonal arrangement, etc.), then such terms can specify a different relative orientation (side-by-side orientation, left-right orientation, diagonal orientation, etc.).

A fluid dispensing assembly used in a printing system can be in an environment that is at an elevated temperature due to use of heating elements in the printing system. For example, a three-dimensional (3D) printing system can use heating elements when forming layers of a 3D object during a 3D printing process.

A 3D printing system forms a 3D object by depositing successive layers of build material. Printing agents dispensed from the 3D printing system can include ink, as well as agents used to fuse powders of a layer of build material, detail a layer of build material (such as by defining edges or shapes of the layer of build material), and so forth.

Although reference is made to use of techniques or mechanisms according to some examples of the present disclosure in a 3D printing system, it is noted that such techniques or mechanisms are also applicable to a two-dimensional (2D) printing system. A 2D printing system dispenses printing fluid, such as ink, to form images on print media, such as paper media or other types of print media. A 2D printing system may also employ heating elements that cause heating during a printing operation.

In addition, although reference is made to printing systems in some examples, it is noted that techniques or mechanisms of the present disclosure are applicable to other types of fluid dispensing systems used in non-printing applications that are able to dispense fluids through nozzles. Examples of such other types of fluid dispensing systems include those used in fluid sensing systems, medical systems, vehicles, fluid flow control systems, and so forth.

A fluid dispensing assembly, such as a printbar, a print cartridge, and so forth, used in a printing system can include components or portions that are sensitive to elevated temperatures. For example, a fluid dispensing assembly can include electronic components. Moreover, portions of the fluid dispensing assembly can be formed using a low-temperature plastic (or other low-temperature material) that is designed to function at a temperature lower than a specified threshold (e.g., 60° Celsius or some other temperature threshold). If the fluid dispensing assembly is not properly cooled, the electronic components and/or the low-temperature material portions of the fluid dispensing assembly may malfunction or may be damaged.

A fluid dispensing assembly can include fluid dispensing devices, such as fluid dispensing dies (also referred to as fluidic dies). A fluid dispensing die can include a substrate and nozzles formed on the substrate. Each nozzle can include a fluid expulsion element, such as a thermal resistor, a piezoelectric element, and so forth, which when activated causes fluid in a fluid chamber of the nozzle to be expelled through an orifice of the nozzle.

A printbar can include fluid dispensing devices extending along a dimension (e.g., width) of the printbar. The fluid ejection devices can be mounted on a print surface of the printbar. In other examples, a fluid dispensing assembly can include a print cartridge that has a fluid dispensing device, or multiple fluid dispensing devices.

According to some implementations of the present disclosure, a fluid dispensing assembly can be provided with vents in a body of the print fluid dispensing assembly bar, to allow a cooling airflow generated by an airflow generator that is external of and separate front the fluid dispensing assembly to be directed into an inner portion of the printbar, such as to cool electronic components and/or portions formed of a low-temperature material.

FIG. 1 is a block diagram of an example fluid dispensing system 100, such as a printing system or other type of system. The fluid dispensing system 100 includes a fluid dispensing assembly 102. If the fluid dispensing system 100 is a printing system, then the fluid dispensing assembly 102 can be a printbar, a print cartridge, and so forth. In some examples, the fluid dispensing assembly 102 is removably installed on a mounting structure 104, which can be a carriage or any other type of mounting structure. The mounting structure 104 can be fixed in position, or alternatively, the mounting structure 104 can be movable.

The fluid dispensing assembly 102 can be handled by a user (e.g., and end user of the fluid dispensing system 100)

for installation onto the mounting structure 104. After installation, the user can also remove the fluid dispensing assembly 102 from the mounting structure 104.

The fluid dispensing assembly 102 includes a body 106. As used here, a "body" of a fluid dispensing assembly can refer to a combination of housing structures of the fluid dispensing assembly, including any part (such as a cover) that is removable. A number of fluid dispensing devices 108 (such as fluidic dies) are mounted on a lower surface 110 of the body 106. In other examples, the fluid dispensing devices 108 can be mounted on a different surface of the body 106, or on multiple surfaces of the body 106.

A handle 112 is attached to an upper surface 114 of the body 106. The handle 112 when gripped by a user allows a user to move the fluid dispensing assembly 102, such as to install or remove the fluid dispensing assembly 102 with respect to the mounting structure 104.

In accordance with some examples of the present disclosure, the body 106 is also provided with vents 116 to allow for cooling air to flow into an inner portion 118 of the body 106, to cool components or portions in the body 106 of the fluid dispensing assembly 102. A "vent" can refer to an opening in a structure that allows for a flow of air to pass through the opening. An "inner portion" of the body 106 can refer to an inner part (or multiple inner parts) of the fluid dispensing assembly 102, where such inner part(s) is (are) inaccessible from outside the body 106.

An airflow generator 120 is provided in the fluid dispensing system 100. The airflow generator 120 is external of and separate from the fluid dispensing assembly 102. The airflow generator 120 is separate in the sense that the airflow generator 120 is not mounted on or part of the fluid dispensing assembly 102.

The airflow generator 120 can include a fan or multiple fans, for example. In other examples, the airflow generator 120 can be implemented with any other type of device designed to induce a flow of air in the fluid dispensing system 100. A cooling airflow produced by the airflow generator 120 is indicated generally as 122.

The cooling airflow 122 is directed towards the fluid dispensing assembly 102 when mounted on the mounting structure 104. The cooling airflow 122 can also be directed to other components of the fluid dispensing system 100. The cooling airflow 122 is able to enter through the vents 116 into the inner portion 118 of the body 106 of the fluid dispensing assembly 102.

Although reference is made to multiple vents 116, it is noted that in other examples, just one vent can be provided in the body 106 of the fluid dispensing assembly 102. Also, in further examples, vents 116 can be provided on more than one surface of the body 106 of the fluid dispensing assembly 102.

The fluid dispensing devices 108 are to dispense fluid towards a target 124. In examples where the fluid dispensing system 100 is a 3D printing system, the target 124 can include a 3D object, or a layer (or layers) of a 3D object, which is being formed during a 3D printing operation. The target 124 is placed on a support structure 126. In a 3D printing operation, successive layers of the 3D object are formed on the target structure 126.

In other examples, the fluid dispensing system 100 can be a different type of fluid dispensing system, including a 2D printing system or a non-printing system.

Figure 2:
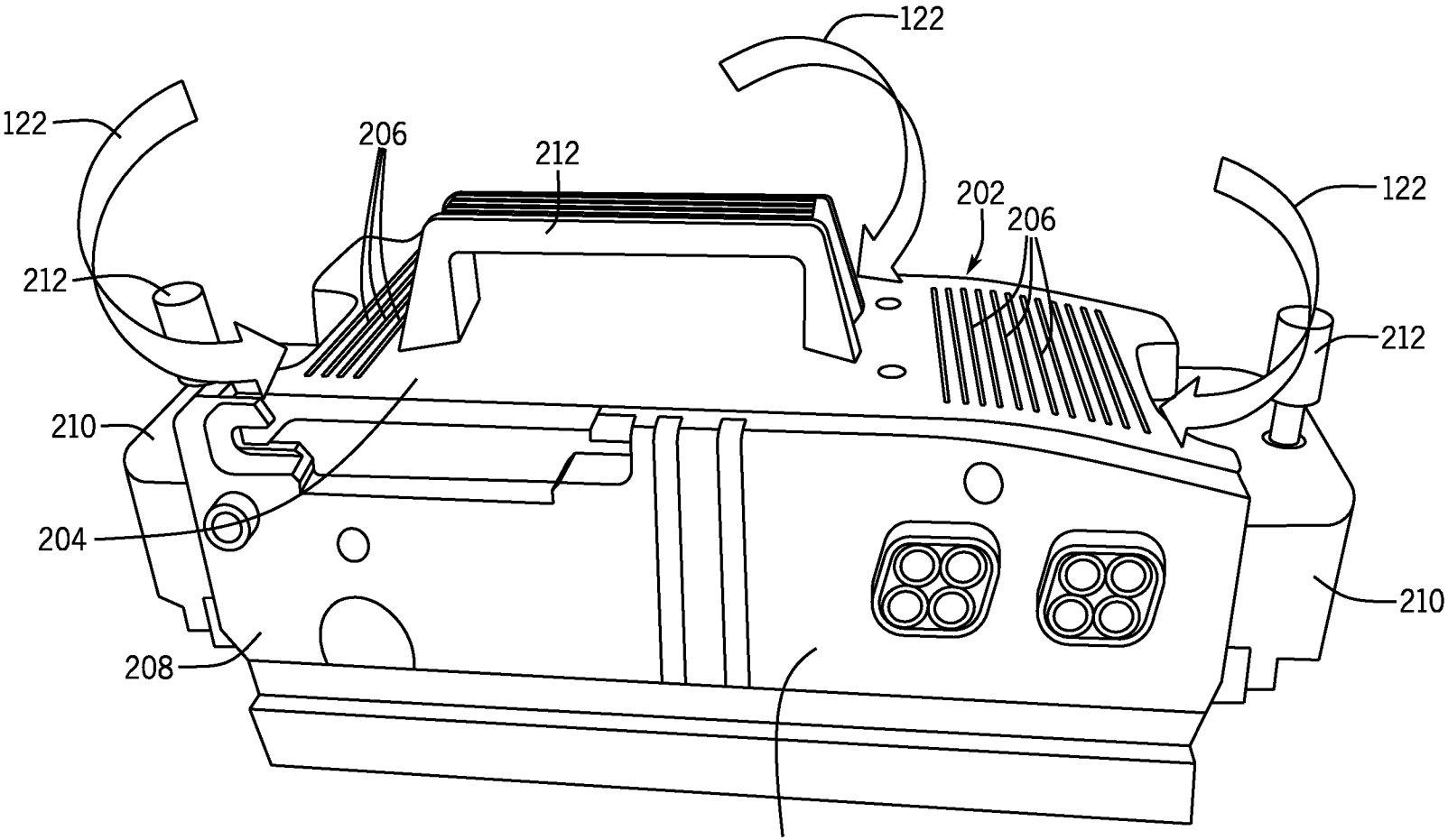
FIG. 2 is a perspective view of a printbar according to some examples.
Figure 3:
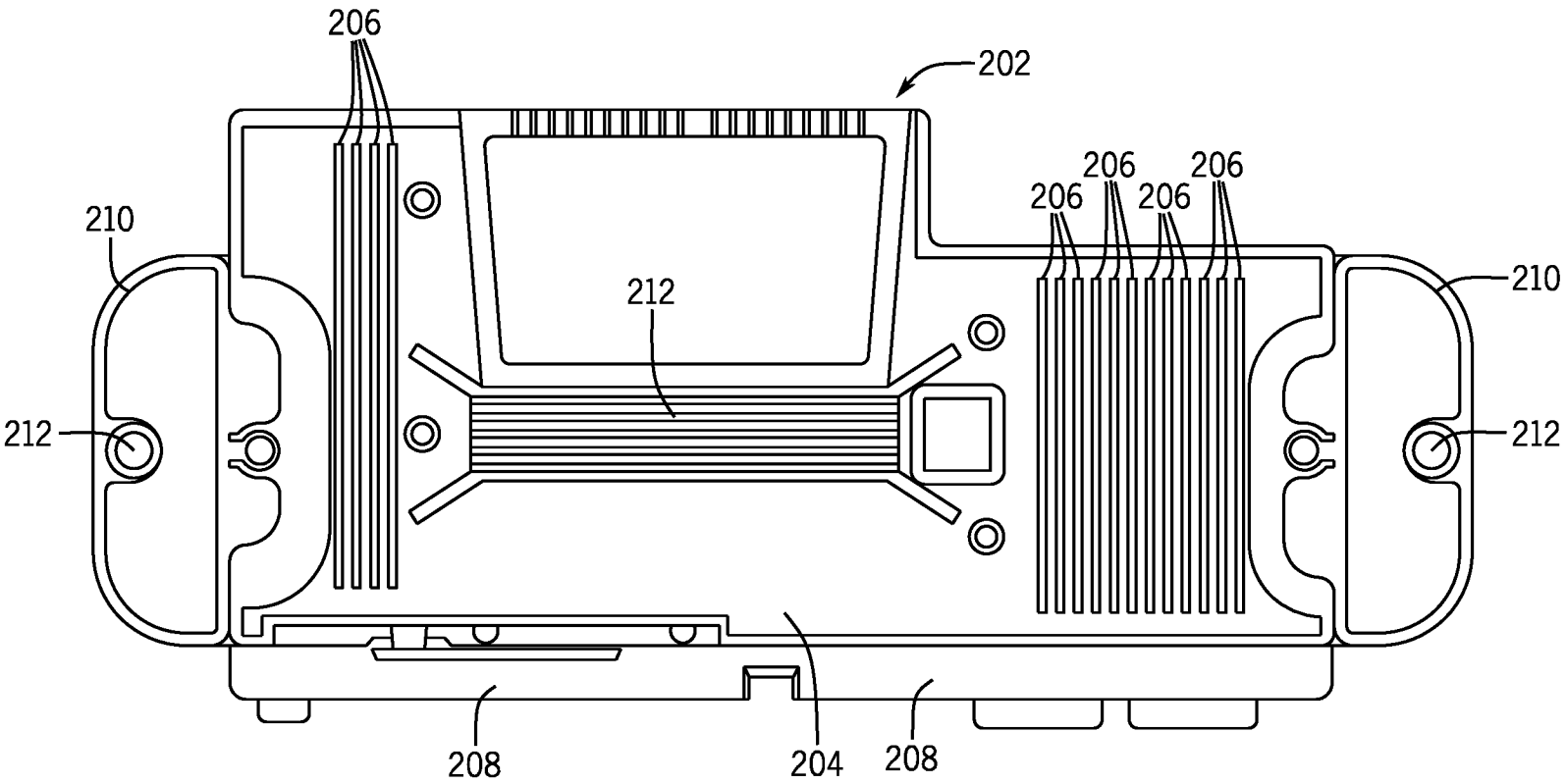
FIG. 3 is a top view of a printbar according to some examples.

FIG. 2 is a perspective view of a printbar 202 according to further examples. FIG. 3 is a top view of the printbar 202 of FIG. 2. The printbar 202 can be an example of the fluid dispensing assembly 102 shown in FIG. 1.

The printbar 202 includes an upper cover 204 that includes vents 206. The upper cover 204 is a protective cover for the printbar 202. The vents 206 allow cooling airflow 122 to flow from the external and separate airflow generator 120 (FIG. 1) through the vents 206 into an inner portion of the printbar 202.

The upper cover 204 has a handle 212 that allows a user to either move the printbar 202 as a whole, or to remove the upper cover 204 from the rest of the printbar 202. The body of the printbar 202 further includes a side housing portion 208. In some examples, an electronic component (or multiple electronic components) can be protected by the side housing portion 208.

The printbar 202 also includes mounting structures 210 that include respective attachment pins 212 for attaching the printbar 202 to a mounting structure, such as the mounting structure 104 of FIG. 1

In addition to electronic components, the printbar 202 according to some examples can also include portions formed of a plastic or other low-temperature material designed to operate at a temperature of less than 60° C. or some other example temperature threshold. If the temperature of the printbar 202 were allowed to exceed the temperature threshold, then damage can occur to the low-temperature material portions of the printbar 202. Also, damage can occur to electronic components of the printbar 202, or the electronic components may malfunction.

The cooling airflow 122 that passes through the vents 206 to the inner portion of the printbar 202 allows for cooling of the electronic components and the low-temperature materials.

Figure 4:
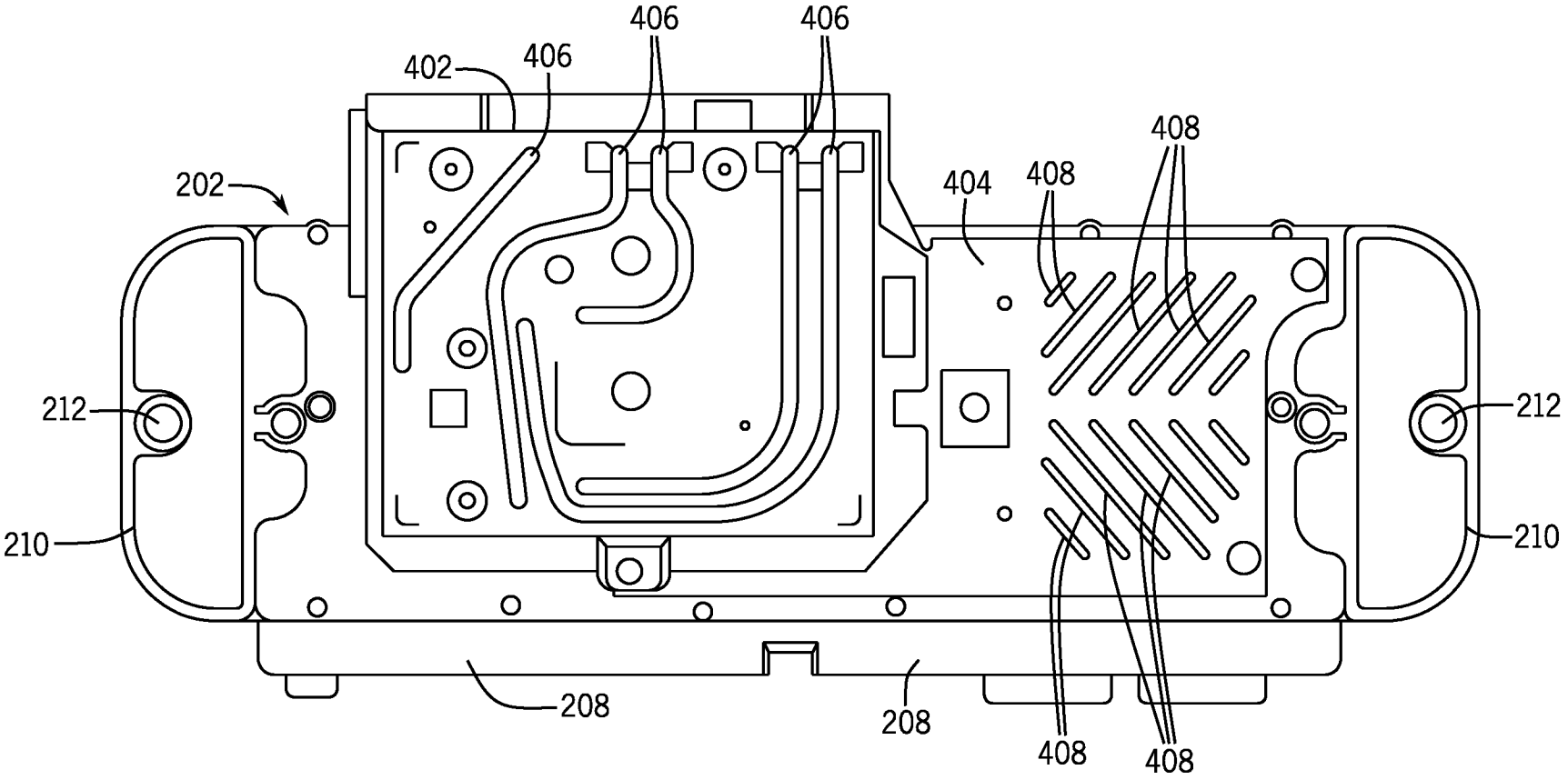
FIG. 4 is a top view of a printbar with a top cover removed, according to some examples.

FIG. 4 is a top view of the printbar 202 with the upper cover 204 removed. Removal of the upper cover 204 exposes a fluidic manifold 402 and a support plate 404 on which the fluidic manifold 402 is mounted. The fluidic manifold 402 includes fluidic channels 406 through which fluids can flow. Examples of fluids that can flow through the fluidic manifold 402 include printing fluids that are to be dispensed by the fluid dispensing devices 108 of FIG. 1, as well as other types of fluids, including gases such as air.

During operation, fluid can be provided to the fluidic manifold 402 through fluidic conduits (e.g., hoses) attached to the printbar 202.

The support plate 404, which can be formed of a metal or another material, includes vents 408. Cooling airflow that passes through the vents 206 of the upper cover 204 (FIGS. 2, 3) can flow into a space between the upper cover 204 and the support plate 404, and further, the cooling airflow can pass through the vents 408 in the support plate 404 into an inner portion of the printbar 402 that is under the support plate 404.

In some examples, the cooling airflow is to cool non-fluidic portions of the printbar 202. The fluidic portion of the printbar 202 includes the fluidic manifold 402 (and any other portion that includes fluidic conduits).

The non-fluidic portions of the printbar 202 include those portions of the printbar 402 in which fluid does not flow.

Note that the vents 206 in the upper cover 204 (FIGS. 2-3) and the vents 408 in the support plate 404 (FIG. 4) allow for circulation of the cooling airflow. The cooling airflow can enter into a first subset of the vents 206, 408, and can exit through another subset of the vents 206, 408. Alternatively, the cooling airflow can exit through exhaust vents (not shown).

By using the vents 206, 408, according to some examples, ventilation is provided to allow for the fluid dispensing assembly 102 or printbar 202 to operate in a high-temperature environment, such as that of a 3D printing system.

By using ventilation features according to some implementations of the present disclosure, an expensive solution to keep the entire fluid dispensing system at a low temperature can be avoided. Also, fluid dispensing assemblies that include cheaper materials, such as low-temperature plastics, can be used in fluid dispensing systems such as 3D printing systems, which reduces the cost of the fluid dispensing assemblies and thus the overall cost of the fluid dispensing systems. Also, by using the airflow generator (120 in FIG. 1) of the fluid dispensing system that is external of and separate from a fluid dispensing assembly, an airflow generator does not have to be provided on the fluid dispensing assembly itself, such as the printbar, which also reduces the cost of the fluid dispensing assembly.

Additionally, physical contact between the fluid dispensing assembly and another part of the fluid dispensing system, such as a thermal heat sink, does not have to be provided, which reduces complexity in the use of the fluid dispensing assembly.

Figure 5:
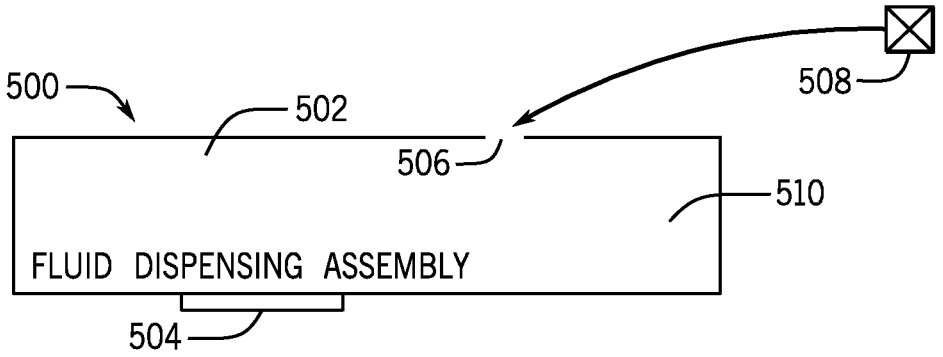
FIGS. 5 and 6 are block diagrams of fluid dispensing assemblies according to further examples.

FIG. 5 is a block diagram of a fluid dispensing assembly 500 that is removably mountable in a fluid dispensing system, according to some examples. The fluid dispensing assembly 500 includes a body 502 and a fluidic die 504 attached to the body 502. A vent 506 is arranged on the body 502 to direct cooling airflow generated by an external airflow generator 508 that is external of and separate from the fluid dispensing assembly into an inner portion 510 of the fluid dispensing assembly 500, the inner portion 510 being within the body 502.

Figure 6:
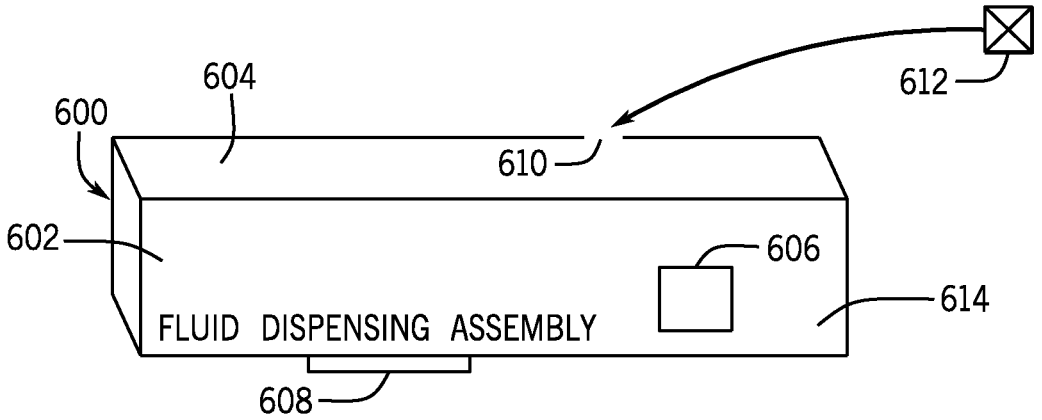

FIG. 6 is a block diagram of a fluid dispensing assembly 600 removably mountable in a system. The fluid dispensing assembly 600 includes a body comprising a housing 602 and a cover 604 that is removable from the housing 602. An electronic component 606 is positioned in the body. A fluid dispensing device 608 is attached to the body and to dispense fluid. A vent 610 is arranged in the cover 604 to direct cooling airflow generated by an external airflow generator 612 that is external of and separate from the fluid dispensing assembly 600 into an inner portion 614 of the fluid dispensing assembly 600, the inner portion 614 containing the electronic component 606.

Figure 7:
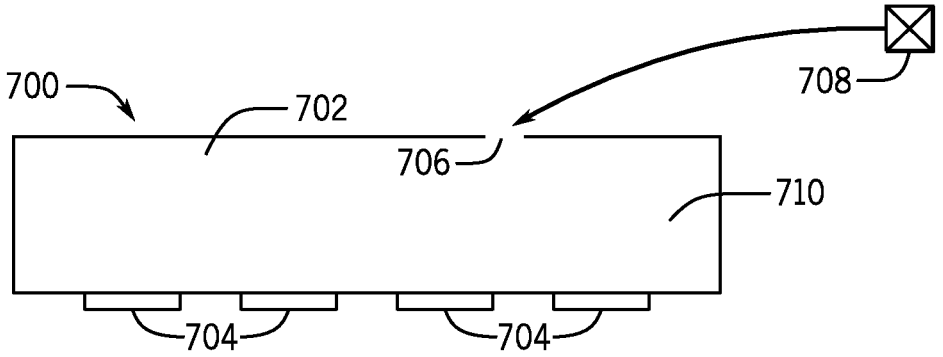
FIG. 7 is a block diagram of a printbar according to additional examples.

FIG. 7 is a block diagram of a printbar 700 removably mountable in a printing system. The printbar 700 includes a body 702, and fluidic dies 704 attached to the body 702. A vent 706 is arranged on the body 702 to direct cooling airflow generated by an external airflow generator 708 that is external of and separate from the printbar 700 into an inner portion 710 of the printbar 700, the inner portion 710 being within the body 702.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing assembly removably mountable in a fluid dispensing system, comprising:

a body;

a fluidic die attached to the body;

a vent arranged on the body to direct cooling airflow generated by an external airflow generator that is external of and not mounted on the fluid dispensing assembly into an inner portion of the fluid dispensing assembly, the inner portion being within the body; and an upper cover and a handle on a top surface of the upper cover, the handle rising from the top surface of the upper cover and having an opening for gripping by a user, wherein the vent is in the top surface of the upper cover.

2. The fluid dispensing assembly of claim 1, further comprising a support plate to support a fluidic manifold, the support plate further comprising a vent to direct the cooling airflow received through the vent of the upper cover into a further inner portion within the fluid dispensing assembly.

3. The fluid dispensing assembly of claim 2, wherein the fluidic manifold comprises fluidic channels to carry a fluid to be dispensed by the fluidic die.

4. The fluid dispensing assembly of claim 3, wherein a plurality of vents are arranged on the body, a plurality of vents are included in the support plate, the cooling airflow is to enter the inner portion through a first subset of the plurality of vents arranged on the body and a first subset of the plurality of vents included in the support plate, and the cooling airflow is to exit the inner portion through a second subset of the plurality of vents arranged on the body and a second subset of the plurality of vents included in the support plate.

5. The fluid dispensing assembly of claim 1, wherein the body comprises a portion formed of a low temperature material, and the cooling airflow is to cool the portion.

6. The fluid dispensing assembly of claim 1, further comprising an electronic component, the cooling airflow to cool the electronic component.

7. A fluid dispensing assembly removably mountable in a system, comprising:

a body comprising a housing and an upper cover;

an electronic component in the body;

a fluid dispensing device attached to the body and to dispense fluid;

a vent arranged in the upper cover to direct cooling airflow generated by an external airflow generator that is external of and not mounted on the fluid dispensing assembly into an inner portion of the fluid dispensing assembly, the inner portion containing the electronic component; and a handle on a top surface of the upper cover, the handle rising from the top surface of the upper cover and having an opening for gripping by a user, wherein the vent is in the top surface of the upper cover.

8. The fluid dispensing assembly of claim 7, wherein the handle is grippable by the user to install the fluid dispensing assembly into the system, or remove the fluid dispensing assembly from the system.

9. The fluid dispensing assembly of claim 7, wherein the body comprises a portion formed of plastic, and the cooling airflow is to cool the plastic portion.

10. A printbar removably mountable in a printing system, comprising:

a body comprising an upper cover and a printbar housing;

fluidic dies attached to the body;

a vent arranged on the body to direct cooling airflow generated by an external airflow generator that is external of and not mounted on the printbar into an inner portion of the printbar, the inner portion being within the body; and a handle on a top surface of the upper cover and rising from the top surface of the upper cover, wherein the handle has an opening for gripping by a user, and the vent is in the top surface of the upper cover.

11. The printbar of claim 10, further comprising a support plate to support a fluidic manifold comprising fluidic channels to carry a fluid to be dispensed by the fluidic dies, the support plate further comprising a vent to direct the cooling airflow received through the vent of the upper cover into a further inner portion within the printbar.

12. The printbar of claim 11, wherein a plurality of vents are arranged in the upper cover, a plurality of vents are included in the support plate, the cooling airflow is to enter the inner portion through a first subset of the plurality of vents arranged in the upper cover and a first subset of the plurality of vents included in the support plate, and the cooling airflow is to exit the inner portion through a second subset of the plurality of vents arranged in the upper cover and a second subset of the plurality of vents included in the support plate.

13. The printbar of claim 10, wherein the body comprises a portion formed of a low temperature material, and the cooling airflow is to cool the portion.

14. The printbar of claim 10, further comprising an electronic component, the cooling airflow to cool the electronic component.

* * * * *